US005823367A

United States Patent [19]

Moran, Jr.

[11] Patent Number: 5,823,367

[45] Date of Patent: Oct. 20, 1998

[54] ADAPTER FOR HOLDING A PAN IN A FOOD SERVING STATION

[75] Inventor: Robert E. Moran, Jr., Sheboygan Falls, Wis.

[73] Assignee: The Vollrath Company, L.L.C., Sheboygan, Wis.

[21] Appl. No.: 837,356

[22] Filed: Apr. 17, 1997

Related U.S. Application Data

[63] Continuation of Ser. No. 379,345, Jan. 27, 1995, abandoned.

[51] Int. Cl.[6] ..... A47G 29/00

[52] U.S. Cl. ..... 211/126.1; 108/25

[58] Field of Search ..... 211/126, 133; 312/116, 126, 137, 205; 108/25, 26; 52/658, 656.1, 656.2; D34/14, 19, 20; 99/448, 449; 206/821, 562; 220/484; 404/25, 26

[56] References Cited

U.S. PATENT DOCUMENTS

| | | | |
|---|---|---|---|
| D. 190,414 | 5/1961 | Rhoads | D34/20 |
| 1,277,253 | 8/1918 | Paschal . | |
| 2,431,082 | 11/1947 | Sayles | 404/26 |
| 2,976,391 | 3/1961 | Carlson | 219/35 |
| 3,046,971 | 7/1962 | Hogshire | 126/33 |
| 3,294,000 | 12/1966 | Pelsue | 404/26 |
| 3,608,770 | 9/1971 | Naimoli et al. | 220/16 |
| 3,968,600 | 7/1976 | Bowman | 404/26 |
| 4,029,425 | 6/1977 | Pelsue | 404/25 |
| 4,033,461 | 7/1977 | Nevai | 108/25 |
| 5,228,396 | 7/1993 | Pfaff | 99/470 |

OTHER PUBLICATIONS

Dimensional drawings of commercially available food serving station made by Servo Lift Eastern Corp.

*Primary Examiner*—Ramon O. Ramirez
*Assistant Examiner*—Willie Berry, Jr.
*Attorney, Agent, or Firm*—Foley & Lardner

[57] ABSTRACT

An adapter for mounting an oversize or sheet pan over at least two wells of a food serving station includes a frame structure surrounding a central aperture. The adapter includes a lower support surface designed to rest on the upper surface of a serving station, an upper support surface for supporting the peripheral flange of a sheet pan and side panels between the upper and lower surfaces for raising the pan above the upper surface of the station. Downwardly extending locating flanges protrude into the wells to maintain the adapter in place. Inclined centering flanges extend into the aperture for urging the pan into the aperture. The adapter can be positioned over the wells when a sheet pan is to be used and is easily removed from the station when standard food trays are to be placed in the wells.

11 Claims, 2 Drawing Sheets

ADAPTER FOR HOLDING A PAN IN A FOOD SERVING STATION

This is a continuation of Ser. No. 08/379,345 filed Jan. 27, 1995, now abandoned.

BACKGROUND OF THE INVENTION

1. Field of the Invention

The present invention relates generally to a device for holding a pan over at least one well of a food serving station. More particularly, the invention relates to an adapter designed to be fitted to a food warming and serving station. The adapter is designed fit over at least one well in the station, and preferably at least two adjacent wells, to receive and support a pan larger than the wells could normally accommodate, such that the pan and food placed in the pan are conveniently held in the serving station and, where desired, can be heated by moist or dry heat from the well.

2. Description of Related Art

Serving stations or bars are well known in the food service field, particularly for serving hot and cold dishes in restaurant, cafeteria and institutional settings. Such serving stations generally include a table having a flat upper plate or support surface, typically made of stainless steel to facilitate cleaning and maintenance. Wells are formed in the upper support surface and are suitably dimensioned to receive standard-sized food trays and pans from which portions of food are removed and served on plates. The serving stations may be stationary or movable, such as on casters, and typically include a system for applying dry and moist heat within a space below the wells for maintaining the trays and food at a desired temperature. Somewhat smaller, table-top serving stations are also known, in which a support surface, typically mounted on legs, holds trays in similar wells. Heat is often applied to the food in the latter type of stations by prepackaged cannisters of a combustible material placed beneath the wells.

Although such serving stations are useful in displaying and warming large quantities of food cooked or placed in trays dimensioned to fit within the wells provided, they typically do not accommodate trays and pans larger than the wells, such as large sheet pans used convenient for cooking and serving pizza and other dishes. Consequently, either foods cooked or held in these larger pans is removed from the pans and placed into the standard-sized trays in the serving station, or the larger pans are placed directly over the wells, where they may slide freely on the upper surface of the station. In the latter case, heat from the wells is not efficiently directed to the pans and the risk that the pans may fall from the station, along with the food they contain, is greatly increased.

A need therefore exists for a device permitting pans and trays larger than the wells in food serving stations to be placed and held securely on such stations. In particular, such a device should advantageously position such pans over at least one well in the food serving stations to afford warming of the food in the pans by moist or dry head from the wells. Moreover, the device should be capable of quick and simple installation on and removal from the station to permit the station to be used with standard-sized trays as well as the larger pans it is desiged to support.

SUMMARY OF THE INVENTION

The invention features a novel adapter designed to be interposed between the upper support surface of a food serving station and a pan or tray too large to fit within a well in the station. The adapter may be easily installed over wells in the serving station and is removable for cleaning and storage when not in use. Pans or trays placed in the adapter are prevented from sliding on the serving station and may be heated directly from a heat source in the wells. Thus, in accordance with a first aspect of the invention, an adapter is provided for holding a pan on a food serving station of the type having at least two adjacent wells formed in an upper plate. The adapter includes a pan support frame configured to rest upon the upper plate and to extend over at least two adjacent wells. The frame includes a central depression for receiving a sheet and for positioning the pan substantially over the wells. The adapter also includes at least one projection coupled to the frame and extending downwardly therefrom to engage the food serving station and thereby to locate and retain the adapter over the wells.

In accordance with a preferred embodiment, the invention features an adapter for use with a food service station having a food service table, at least two adjacent wells formed in the table for receiving and supporting trays of food and a heating system for heating the trays of food. The adapter is designed to support a sheet pan of the type having substantially upstanding sides surrounding a central sheet and terminating in an upper peripheral bead. In accordance with this aspect of the invention, the adapter includes a frame configured to fit flush on the table and to extend over at least two adjacent wells in the table. The frame includes a central depression for receiving the sheet pan and for positioning the sheet pan substantially over the wells. The adapter also includes at least one projection coupled to the frame and extending downwardly therefrom to engage the food serving station and thereby to locate and retain the adapter over the wells.

The invention also features a food serving station comprising a food service table having an upper support surface and wells formed therein and suitably dimensioned to receive and support food trays of standard dimensions. The station also includes an adapter removably fitted to the upper support surface and covering at least one well in the table. The adapter includes a frame surrounding a central depression for receiving and supporting a pan of greater dimensions than the wells. The adapter also includes at least one projection extending substantially downwardly from the frame to engage the food serving station and to thereby locate and retain the adapter over the well.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Before beginning the detailed description of the FIGURES and the preferred embodiments shown therein, several general comments will assist in understanding the scope of the invention. The most preferred and illustrated embodiments of the present invention include an adapter in the form of a rectangular frame constructed of four bent metal side members joined by welding at the corners of the frame. The frame is preferably constructed of relatively heavy gauge stainless steel in order to provide a sturdy structure that resists bending and is easily cleaned. The frame is preferably dimensioned to fit over two wells in a food serving station and to lift the bottom of a sheet pan slightly above the upper surface of the station. However, the invention is not intended to be limited to any particular material, configuration or construction technique. For example, the adapter could be made of various metal alloys and stamped or formed from a single or several pieces of material. Similarly, the adapter could be molded from a plastic or resinous material. Moreover, the adapter could be dimensioned to fit over more than two wells in a food serving station, such as to accommodate pans or trays of larger dimensions.

Figure 1:
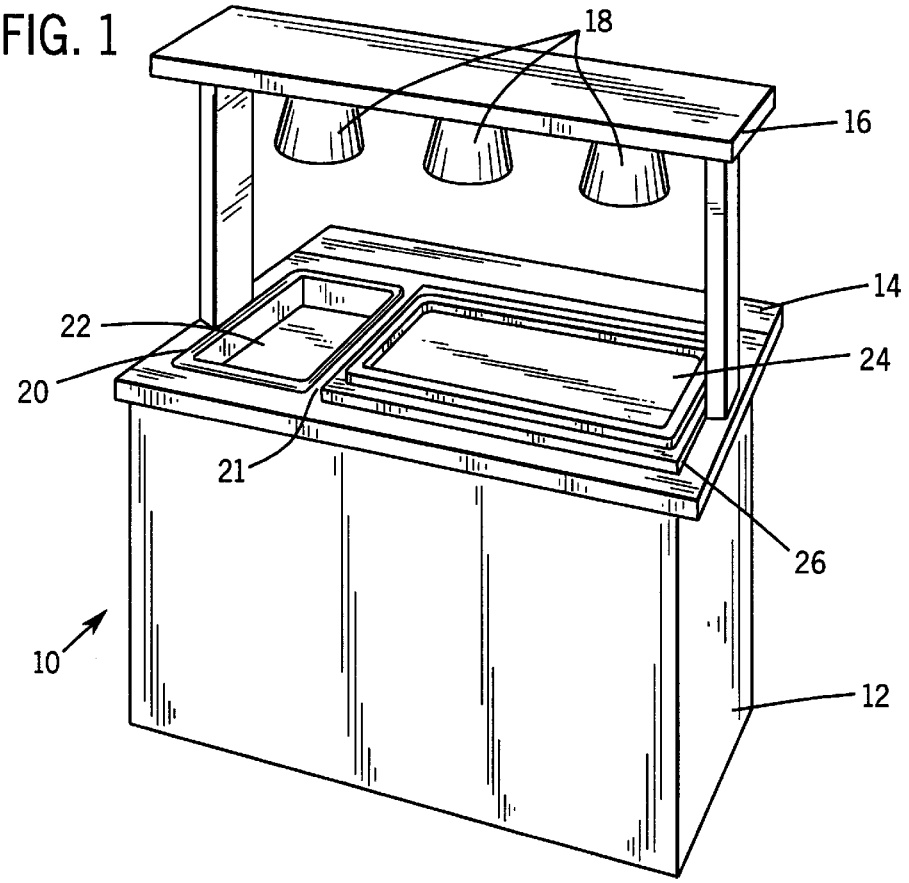
FIG. 1 is a perspective view of a food serving station illustrating a sheet pan mounted in an adapter in accordance with the invention.

Turning now to the drawings and referring first to FIG. 1, a food serving station 10 is illustrated as including a food service table 12 having an upper surface 14 and a lighting and heating fixture 16. Heat lamps 18 may be mounted in fixture 16 and a system of generally known design (not shown) may be provided within table 12 for heating or cooling food placed in the station. Openings or wells 20 are formed in upper surface 14, separated by dividers 21, for receiving trays or pans 22 of food. Dividers 21 are typically formed integrally with upper surface 14, such that wells 20 are of fixed dimensions, generally accommodating trays or pans 22 of standard size. Moreover, station 10 typically includes two or more wells 20 arranged in a row with dividers 21 separating adjacent wells. In use, a tray 22 of food is dropped into each well 20 and retained in the well by a flange or bead (not shown) around the upper periphery of the tray that rests on upper surface 14. Food in the tray may be cooled or warmed in the well, such as by ice or water placed in or circulating through the well.

Figure 2:
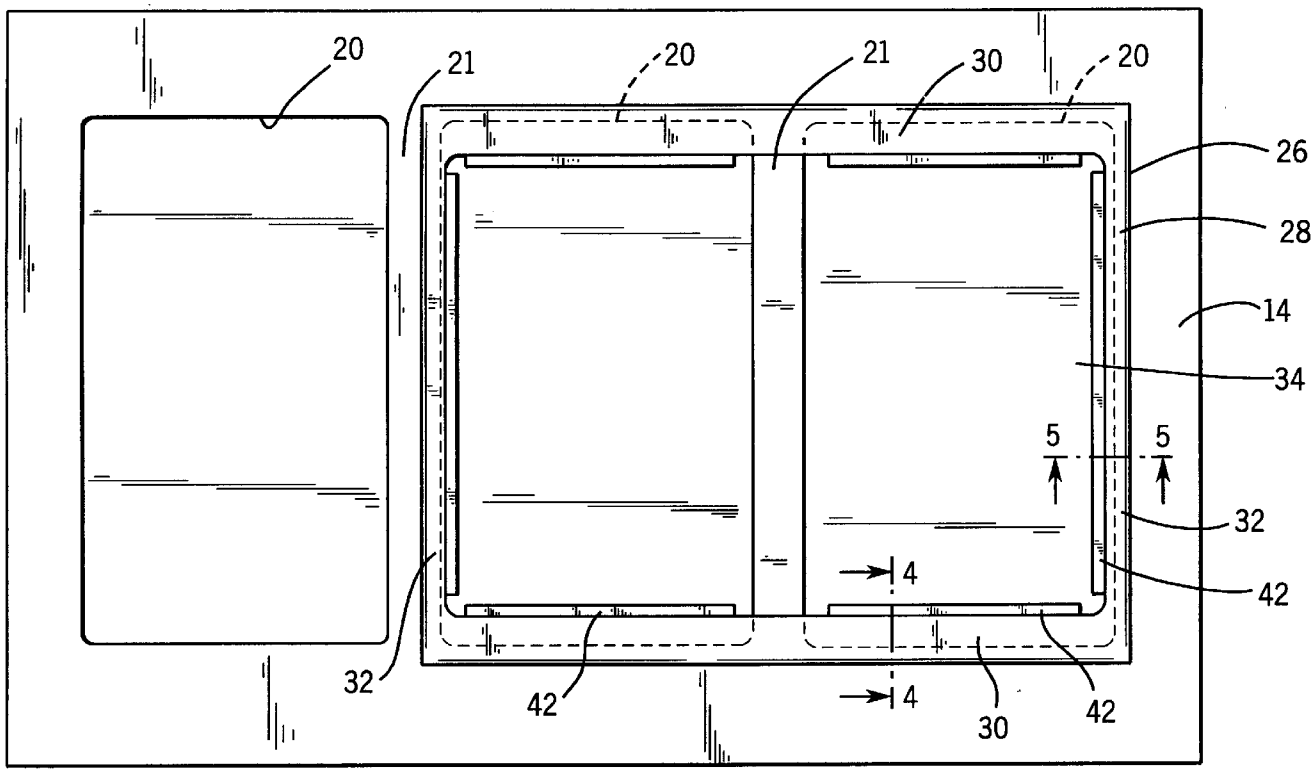
FIG. 2 is a top plan view of the adapter illustrated in FIG. 1, wherein the sheet pan has been removed to show the preferred construction of the adapter as well as a preferred arrangement for locating and retaining the adapter in place over the wells in the food serving station.

In accordance with the present invention, when food is to be served from a sheet pan 24 having dimensions greater than those of wells 20, adapter 26 is removably mounted on upper surface 14 to support the pan. As best illustrated in FIG. 2, adapter 26 is typically a rectangular frame structure 28 having two elongated sides 30 joined to two end sections 32. Sides 30 and ends 32 are preferably formed of bent sheet metal and are welded or otherwise permanently joined at the corners of frame 28 to completely surround a central depression or aperture 34. In the preferred embodiment shown in the FIGURES, sides 30 are of sufficient length to extend slightly beyond the combined length of two adjacent wells 20 including the divider 21 interposed therebetween. Similarly, ends 32 are dimensioned to extend beyond and completely cover the width of the wells 20. It should be noted, however, that sides 30 and ends 32 may be lengthened to cover three or more wells, such as to accommodate even longer pans.

Figure 3:
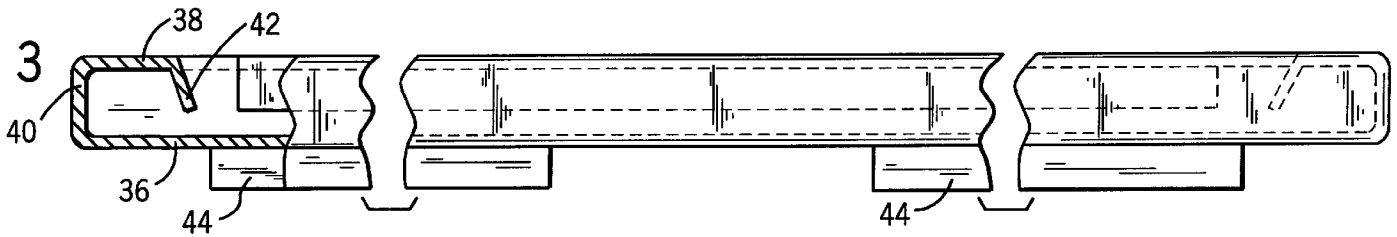
FIG. 3 is a side elevational view of the adapter with a portion of the adapter shown in section to illustrate a preferred structure wherein the sides of the adapter are constructed of bent sheet metal.

As illustrated in FIG. 3, the sides 30 and ends 32 of adapter 26 are preferably bent to present a profiled cross section including a horizontal lower support surface 36, a horizontal upper support surface 38 and a vertical side panel 40 extending between the lower and upper surfaces. Pan centering flanges 42 extend downwardly at an angle from upper surface 38 toward central aperture 34. Moreover, adapter locating flanges 44 extend downwardly from lower surface 36 of sides 30. When installed on food serving station 10, adapter 26 overlies adjacent wells 20 with lower support surface 36 resting flush on upper surface 14 of the station. Locating flanges 44 penetrate slightly into the wells to contact the peripheral portion 46 of upper surface 14 surrounding each well (see FIG. 4), thereby maintaining adapter 26 in place over the wells and preventing adapter 26 from sliding on surface 14.

Figure 5:
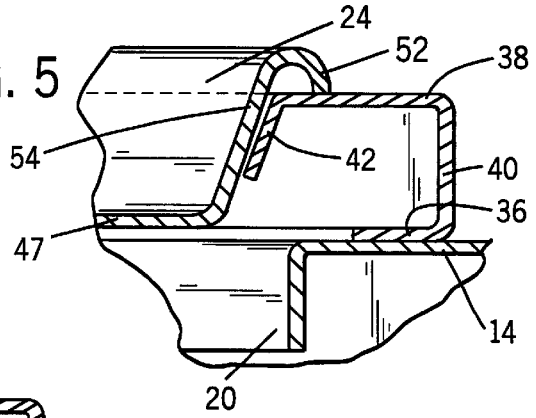
FIGS. 4 and 5 are a sectional views of a portion of the adapter and serving station shown in FIG. 2 along section 4—4 and 5—5 respectively, illustrating how a pan or tray is typically supported and retained in the adapter.
Figure 4:
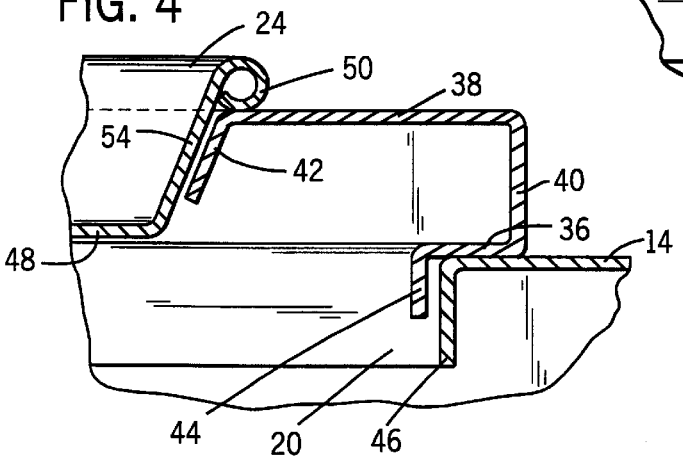

Referring now to FIGS. 4 and 5, adapter 26 supports a sheet pan 24 as follows. Once adapter 26 has been located over wells 20, a sheet pan 24 may be placed within aperture 34. Such sheet pans generally include a planar bottom 48, an upper peripheral flange in the form of a closed bead 50 (see FIG. 4) or an open lip or bead 52 (see FIG. 5), and inclined sides 54 extending between bottom 48 and peripheral flange 50, 52. Adapter 26 is appropriately dimensioned such that centering flanges 42 urge pan 24 into aperture 34 as it is lowered into the adapter and peripheral flange 50, 52 contacts and comes to rest on upper support surface 38. Moreover, side panel 40 is of sufficient height to raise pan 24 above the level of upper surface 14 of station 10, thereby avoiding interference from dividers 21, which could otherwise contact pan bottom 48. Thus installed, pan 24 is not only securely located on the surface 14 of station 10 but, where a heating or cooling system is provided in wells 20, may be heated or cooled by the same system. When trays 22 of standard dimensions is to be installed in place of pan 24, adapter 26 is lifted from wells 20 and removed from station 10.

While the invention is susceptible to various modifications and alternative forms, specific embodiments have been shown and described by way of example in the foregoing drawings and detailed description. However, it should be understood that the invention is not intended to be limited to the particular forms disclosed. Rather, the invention is intended to cover all modifications, equivalents and alternatives falling within the spirit and scope of the invention as defined by the appended claims.

What is claimed is:

1. In a food serving station having a food service table, at least two adjacent wells formed in the table for receiving and supporting trays of food and a heating system for heating the trays of food, an adapter for supporting a sheet pan of the type having substantially upstanding sides surrounding a central sheet and terminating in an upper peripheral bead, the adapter comprising:

a frame configured to fit flush on the table and to extend over at least two adjacent wells in the table, the frame including a central depression for receiving the sheet pan and an upper support surface for engaging the peripheral bead; and at least one projection coupled to the frame and extending downwardly therefrom to engage the food serving station and thereby to locate and retain the adapter over the wells.

2. The adapter of claim 1, further comprising a central aperture surrounded by the frame and located so as to overlie at least one of the wells when the adapter is positioned on the food serving station.

3. The adapter of claim 1, wherein the projection is a flange extending substantially downwardly from the frame so as to enter at least one of the wells when the adapter is positioned on the food serving station.

4. The adapter of claim 3, wherein two such flanges are provided for each well over which the adapter is designed to extend, the flanges for each well being suitably located to contact in diametrically opposed locations in the respective well.

5. A food serving station comprising:

a food service table having an upper support surface and wells formed therein and suitably dimensioned to receive and support food trays of standard dimensions; and an adapter removably fitted to the upper support surface and covering at least one well in the table, the adapter including a frame surrounding a central depression for receiving and supporting a pan of greater dimensions than the wells, the adapter also including at least one projection extending substantially downwardly from the frame to engage the food serving station and thereby to locate and retain the adapter over the well.

6. The food serving station of claim 5, wherein the table includes at least two adjacent wells and the adapter is suitably dimensioned to cover two adjacent wells.

7. The food serving station of claim 5, wherein the adapter further comprising a central aperture surrounded by the frame.

8. The food serving station of claim 5, wherein the projection is a substantially vertical flange that extends into at least one of the wells when the adapter is positioned on the upper plate.

9. The food serving station of claim 8, wherein two such flanges are provided for each well over which the adapter is designed to extend, the flanges for each well being suitably located to contact in diametrically opposed locations in the respective well.

10. The food serving station of claim 5, wherein the frame has a height sufficient to raise the pan above the upper support surface.

11. The food serving station of claim 5, wherein the frame is a rectangular structure made of stainless steel.

* * * * *